US006032574A

United States Patent [19]

Brayton et al.

[11] Patent Number: 6,032,574

[45] Date of Patent: Mar. 7, 2000

[54] RE-CONFIGURABLE MODULAR FOOD PROCESSING CELLS

[76] Inventors: Darryl D. Brayton, 2501 Rose; Stephen G. Romero, 4823 Forsythia St., both of West Richland, Wash. 99353; Howard M. Rickard, 619 Benham St., Richland, Wash. 99352

[21] Appl. No.: 09/168,203

[22] Filed: Oct. 6, 1998

Related U.S. Application Data

[60] Provisional application No. 60/060,955, Oct. 6, 1997.

[51] Int. Cl.[7] ..... A23L 1/00

[52] U.S. Cl. ..... 99/486; 99/495; 99/510; 364/400; 364/578

[58] Field of Search ..... 99/325–331, 352–355, 99/357, 386, 443 C, 468, 484, 485, 486, 489, 492, 495, 510; 126/299 R, 39 R, 299 D; 177/120, 210 C, 245; 186/44; 222/413; 312/198, 140.1, 111, 128; 364/477.05, 400, 578, 149, 479.09; 452/142; 426/231, 233, 523

[56] References Cited

U.S. PATENT DOCUMENTS

| | | | |
|---|---|---|---|
| 4,474,303 | 10/1984 | Maccise | 206/545 X |
| 4,885,677 | 12/1989 | Heilman et al. | 364/184 |
| 4,919,950 | 4/1990 | Mak | 99/486 X |
| 4,920,251 | 4/1990 | Whitenack et al. | 219/401 |
| 5,033,366 | 7/1991 | Sullivan | 99/352 |
| 5,038,572 | 8/1991 | Bruijne et al. | 99/486 X |
| 5,172,328 | 12/1992 | Cahlander et al. | 364/400 X |
| 5,454,753 | 10/1995 | Marchese | 452/142 |
| 5,513,908 | 5/1996 | Williams | 312/140.1 |
| 5,522,309 | 6/1996 | Mizobuchi et al. | 99/468 X |
| 5,572,984 | 11/1996 | Alden et al. | 126/299 R |
| 5,573,082 | 11/1996 | Conlan et al. | 312/198 X |
| 5,738,578 | 4/1998 | Marchese | 452/142 |

*Primary Examiner*—Timothy F. Simone
*Attorney, Agent, or Firm*—David S. Thompson

[57] ABSTRACT

Re-configurable modular food processing cells (10) consisting of rapidly re-configurable functional modules (50) are easily transported to any site for appropriate reconfiguration to process harvested crop material. Each cell (10) provides a shipping container-type enclosure (20), and is therefore highly transportable. Within each modular food processing cell are a plurality of functional modules (50), each module adapted for a specific food processing function, such as cleaning, grinding or filling or labeling containers. Transitional fixtures and fittings (80) allow the output of a first functional module to be input into a second functional module. A computer control system (30), carried by each cell (10), controls the operation of each module (50) by means of control circuitry (40) and video display instructions to the module operator personnel (16). A re-configurable deck flooring (60), and optionally a re-configurable ceiling (70), allows rapid rearrangement and customization of the interior floor plan and associated functionality of the container cell (10). While in a preferred embodiment of the invention the cells are housed within shipping containers, it in an alternate version of the invention the cells can be operated in lines that are within a standard facility, i.e., without a shipping container. In such a facility, the cells can be rapidly reconfigured to provide for relatively low scale production quantities, such as with gourmet or specialty foods.

2 Claims, 5 Drawing Sheets

RE-CONFIGURABLE MODULAR FOOD PROCESSING CELLS

CROSS-REFERENCES

This application claims the benefit of U.S. provisional application having Ser. No. 60/060,955 filed Oct. 6, 1997.

BACKGROUND

Processed food is an ever-growing portion of the food market. A large factor influencing the rise of this segment of the market is the demand by consumers for convenience food. Another factor increasing the quantity of processed food is the need for food to be preserved for consumption out-of-season. As a result, a considerable and extensive food-processing industry has been developed.

Most food-processing plants resemble large factories; as a result, the cost of food processing facilities is considerable. This cost has a significant impact on two principle market areas.

"Gourmet" or "specialty" type foods are often sold in small quantities with a high price mark-up. Using conventional factory-like production facilities, it is difficult for small business to establish a private label and trademark and brand recognition. What is needed is a rapidly re-configurable modular food processing cell having a configuration that could be adapted to process relatively low-scale production quantities, thereby allowing a smaller concern to avoid the capital investment required to build factory-like production facilities.

Similarly, in the developing world, food processing facilities are often not available. As a result, food may rot in the fields or be sold at distress prices. Food production is therefore lowered, agricultural prices become unstable, and economic hardship results. Again, what is needed is for a rapidly re-configurable modular food processing cell having a configuration that could be adapted to process relatively low-scale production quantities of a variety of different food products. In addition to minimizing investment, a portable food processing cell could be transported to specific locations on a just-in-time basis. By appropriate scheduling, the food processing cell could be operated almost continuously, on a variety of different crops and would result in less effort spent in transporting masses of perishable food stuffs.

For the foregoing reasons, there is a need for a rapidly re-configurable modular food processing cell that can can be moved rapidly to any desired site, where the cell could be configured by moving and installing modules within the cell for specific food processing functions, such as grinding, canning and packaging, and storage and serving.

SUMMARY

The present invention is directed to an apparatus that satisfies the above needs. A novel rapidly re-configurable modular food processing cell is provided that is easily transported to any site, that contains a number of re-configurable functional modules associated with different food processing tasks, and that is reasonable in cost per production unit.

The rapidly re-configurable modular food processing cell of the present invention provides some or all of the following structures:

(A) At least one food processing cell. In higher-volume or in more complex operations, where a greater number of processing steps are involved, a greater number of food processing cells may be required. Each food processing cell provides some or all of the following:

(a) A superstructure, such as a shipping container used by Sea/Land or CONEX for ocean, train or truck transport, or a modified diesel truck trailer, or container adapted for drop by aircraft, provides the support structure and housing of each individual food processing cell. This housing structure may be removed if the cells are to be operated in a stand-alone production facility.

(b) A re-configurable deck flooring, and optionally a re-configurable ceiling, allows rapid rearrangement and customization of the interior floor plan and associated functionality of the container body. Power, water, sewer compressed gas and other required utilities are provided through connections below the re-configurable deck flooring or above the re-configurable ceiling.

(c) A computer control system controls the operation of the modules contained by each cell directly, or by providing visual instructions to an operator. The instructions may appear on a speaker, monitor or equivalent flat panel display. Where a monitor or display is used, textual or graphical output will be displayed to alert the operator to perform required tasks. Where input is required, a standard or custom keyboard, membrane keyboard, pointing device, touch screen and/or voice control apparatus will be available to the operators of each module. Operator control may be local or remote (e.g., via the internet). Communications may exist within and/or between, any and all cells, via a data network (e.g., ethernet or other data highway).

(d) Each food processing cell will contain a plurality of functional modules. Individual modules carry known types of machinery adapted for each major process involved in food processing.

(i) Control circuitry, carried by machinery in each functional module, interfaced with a computer control system, allows the automation of the operations of each module, and interaction between modules and/or cells.

(B) Standardized transition fixtures and fittings between modules allow the output of one module to be the input of an adjacent module, within a single food processing cell.

(C) Standardized transition fixtures and fittings between modular food processing cells, each cell containing one or more functional modules, allow the output of one cell to be the input of an adjacent cell.

It is therefore a primary advantage of the present invention to provide agile manufacturing lines consisting of rapidly re-configurable modular food processing cells wherein each cell is comprised of a plurality of functional modules for automating individual steps in the food processing process, and wherein the modules may be rearranged, swapped or reconfigured, as indicated by specific needs.

Another advantage of the present invention is to provide agile manufacturing lines consisting of rapidly re-configurable modular food processing cells where a number of cells can be combined, as needed, to accomplish larger tasks.

Another advantage of the present invention is to provide agile manufacturing lines consisting of rapidly re-configurable modular food processing cells that may be easily transported from place to place, and that are adaptable for use in or near agricultural fields.

Another advantage of the present invention is to provide agile manufacturing lines consisting of rapidly re-configurable modular food processing cells that may be transported in Sea/Land- or CONEX-type shipping boxes, wherein each shipping box additionally forms the superstructure or housing of a modular food processing cell, i.e. the minimum manufacturing facility.

Another advantage of the present invention is to provide agile manufacturing lines consisting of rapidly re-configurable modular food processing cells that are adapted for the production of food in relatively small quantities, e.g. gourmet or specialty foods, and that may be housed in a facility.

Another advantage of the present invention is to provide agile manufacturing lines consisting of rapidly re-configurable modular food processing cells that are adapted for the preservation of food in developing countries worldwide and also for crisis crop preservation by areas hit by natural or manmade disaster.

DRAWINGS

These and other features, aspects, and advantages of the present invention will become better understood with regard to the following description, appended claims, and accompanying drawings where:

DESCRIPTION

Figure 1:
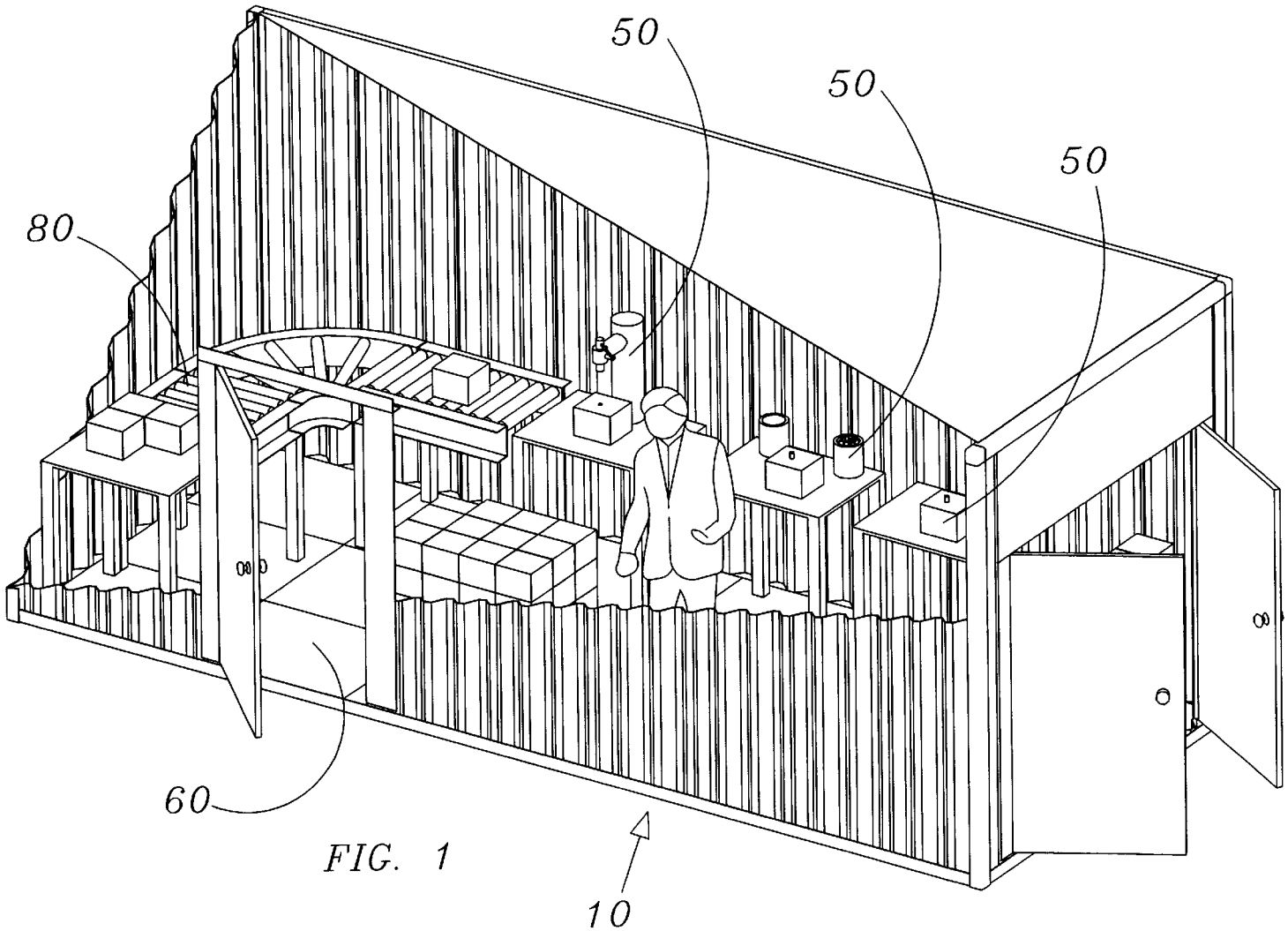
FIG. 1 is a perspective view of a version of a re-configurable modular food processing cell, having the container body structure removed for better illustration of the functional modules contained within.
Figure 2:
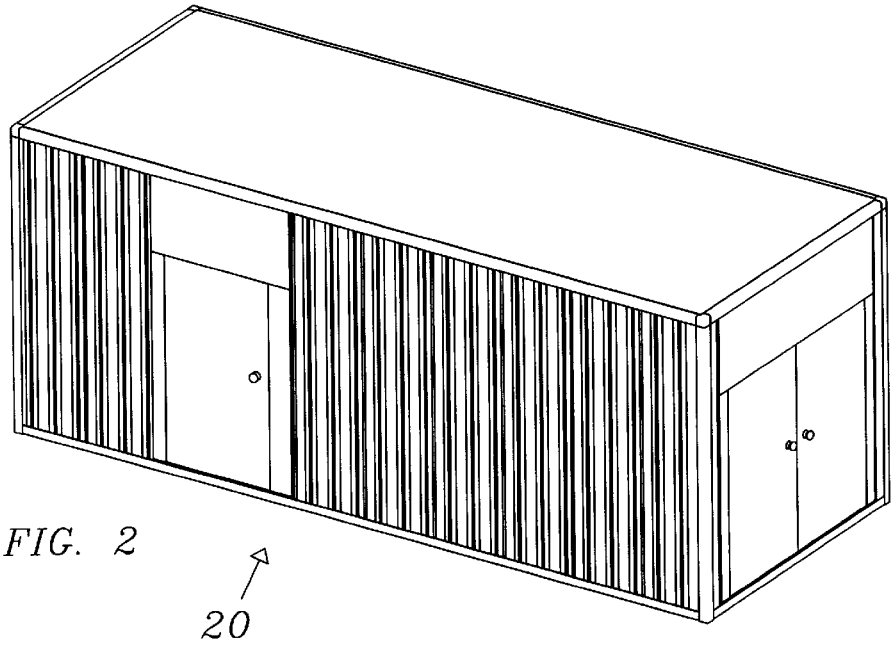
FIG. 2 is a perspective view of a processing cell, showing in particular an example of the container body structure.
Figure 1A:
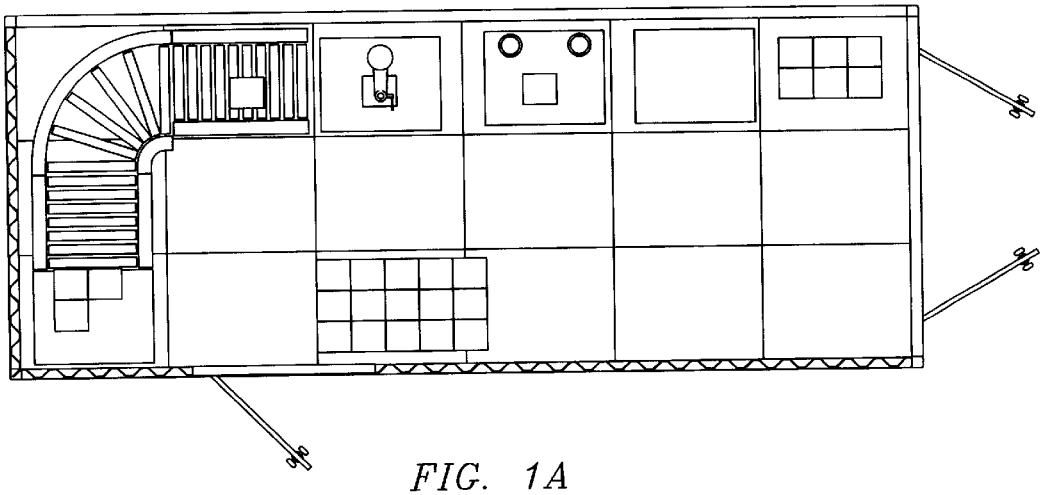

As seen in FIGS. 1 through 5, re-configurable modular food processing cells 10 consisting of rapidly re-configurable functional modules 50 are easily transported to any site for appropriate reconfiguration to process harvested crop material. Each cell 10 provides a shipping container-type enclosure 20, and is therefore highly transportable. Within each modular food processing cell are a plurality of functional modules 50, each module adapted for a specific food processing function, such as cleaning, grinding or filling or labeling containers. Transitional fixtures and fittings 80 allow the output of a first functional module to be input into a second functional module. A computer control system 30, carried by each cell 10, controls the operation of each module 50 by means of control circuitry 40 and video display instructions to the module operator personnel 16. A re-configurable deck flooring 60, and optionally a re-configurable ceiling 70, allows rapid rearrangement and customization of the interior floor plan and associated functionality of the container cell 10. While in a preferred embodiment of the invention the cells are housed within shipping containers, it in an alternate version of the invention the cells can be operated in lines that are within a standard facility, i.e., without a shipping container. In such a facility, the cells can be rapidly reconfigured to provide for relatively low scale production quantities, such as with gourmet or specialty foods.

Figure 4:
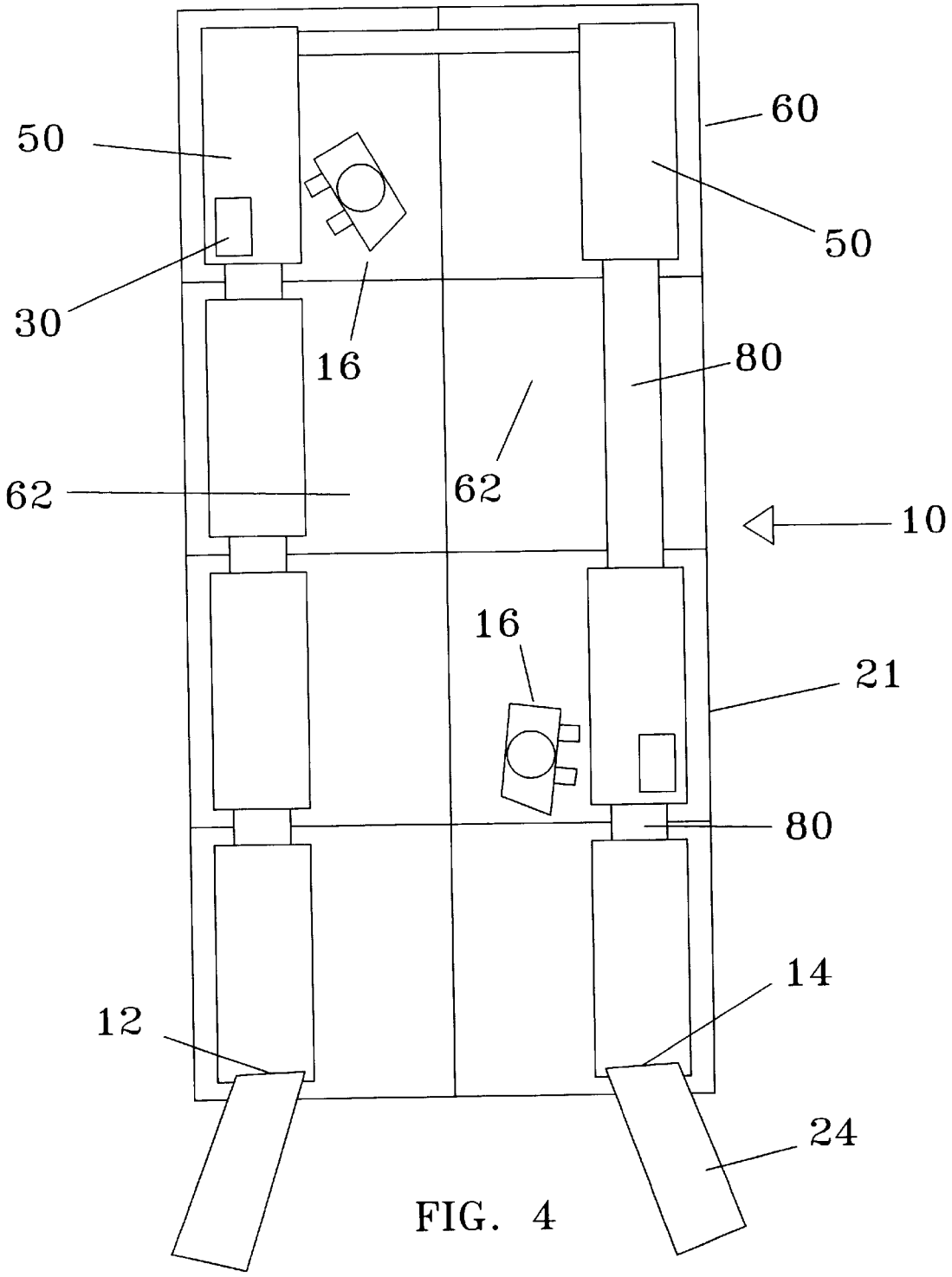
FIG. 4 is a orthographic plan view of a version of the processing cell, having the top removed to reveal a number of functional modules carried by the re-configurable deck flooring, and showing two operator personnel working with the computer control system.

As seen in the cut-away view of FIG. 1, a re-configurable modular food processing cell 10 contains a plurality of functional modules 50, each associated with a food-processing function. FIG. 4 illustrates the relationship and interconnection of the food-processing modules carried within a cell 10. In the operation of the cell, raw food product is introduced into an input 12 associated with one or more food processing cell(s) 10, and finished, packaged and preserved food products exit form the output 14 of the cell.

In higher-volume applications, or in more complex operations where a greater number of processing steps are involved, more than one food processing cell may be required, thereby forming a line consisting of a plurality of re-configurable modular food processing cells. Where two or more food processing cells are used, it is generally the case that the material leaving the output 14 of a first food processing cell is introduced into the input 12 to a second food processing cell. For example, a conveyor may transport partially processed food material from one cell to another cell.

In another example, an entire cell may be devoted to the production of electricity, fresh water supply, waste processing, compressed gas production and other utilities for use in applications, such as in developing countries or remote fields, where standard utilities may not be readily available.

In one version of the invention, a cell may be adapted to store, serve and distribute ready-to-eat food. In a developing nation scenario, such a cell may be adapted to distribute cereal, stew or similar staple food. This is particularly advantageous where either chronic or short-term disaster requires direct food distribution, or where there is no reliable food-distribution channel in place. In a developed nation scenario, the cell may be adapted to distribute food in locations such as a country fair, where low-volume, high-quality, extremely fresh food may be in demand.

A container body 20, such as shipping containers used in Sea/Land or CONEX for ocean, train or truck transport, provides the support structure and enclosure of each individual food processing cell. Such standardized containers are rugged, weather tight, adapted for multiple modes of transport and are therefore comparatively inexpensive and extremely portable. A typical container provides rigid walls 21, floor 22 and roof 23, within which the functional modules 50 may be installed.

Some modification of each container body may be necessary for each application, and may depend on the number and type of modules contained within the container body and the type of food product to be processed. For example, where the modules contained within the container body of a cell are insufficient to fully process the food product, it may be the case that additional cells are required and some modification to allow interconnection between the container bodies of each cell may be made. The conveyor 24 used for input and output of product seen in FIG. 4 is one specific example.

A re-configurable deck flooring 60, and optionally a re-configurable ceiling 70 and/or sidewall, allows rapid rearrangement and customization of the interior floor plan and associated functionality of the container cell 10. As seen in FIG. 4, the deck flooring 60 is divided into a number of modular deck sections 62, which may be moved independently. Each modular deck section 62 may be slid, lifted or rolled to any location within the shipping container 20. The structure supporting the deck sections within the shipping container 20 may be varied, but in a preferred implementation, the deck sections move on rails supported above the floor 22 of the shipping container 20. The space between the deck flooring 60 and floor 22 of the container 20 provides space for utility lines, such as hot and cold water, waste, electricity, gas, compressed air, hydraulic power and others. Such utility lines may be disconnected before deck section are moved, and reattached after each deck section and associated functional module is positioned.

As seen in FIG. 4, each deck section 62 supports, and is associated with, a functional module 50. As a result, rearrangement of the deck sections within the shipping container results in rearrangement of the functional modules. Because different food processing applications require different functional modules, and different sequences of functional modules, re-arrangement of the deck sections 62 within the container 20 results in a different overall functionality of the modular food processing cell 10. It is frequently the case that not all functional units are required in all applications; therefore some deck sections 62 and their functional modules 50 may be segregated to an unused portion of the container 20 at some times.

Utilities, such as electricity, gas, water, sewer, compressed air, vacuum, hydraulic power and others may be routed between the re-configurable deck flooring 60 and above the floor 22 of the container 20. Such utility lines are provided through passages in the deck flooring, ceiling and/or sidewalls. Once positioned, the deck flooring provides sufficient hardware to fasten the deck sections and modules in place for operation, storage or transport.

Alternatively, the utility lines may be run between a re-configurable ceiling 70 and the roof 23 of the container 20. The re-configurable ceiling may be formed of a plurality of ceiling sections 72 movable on tracks, rails or other means in a manner similar to the re-configurable deck flooring 60. In a still further alternative embodiment, the utility lines may be run on either side of the sidewalls 21 of the container for easy accessibility to the modules.

A plurality of modules 50 are carried within each food processing cell 10. In a typical embodiment, each module is carried by a deck section 62 of the re-configurable deck flooring 60, and is movable within the modular food processing cell 10.

Individual modules are adapted for each process involved in food processing, and contain known food processing equipment. Each module typically contains food processing machinery adapted for one or more related functions. For example, a module 50 may contain machinery adapted for juice bottling. Other examples of the functionality of the known food processing equipment contained in individual modules include machinery adapted for cleaning, peeling, husking, cutting, heating (baking, boiling, frying, etc.), grinding, bottling, bottle capping, mixing, bagging, irradiating, dehydrating, canning, freezing, mixing, labeling, storage or dispensing.

Each module provides a frame or enclosure 56 adapted to support and contain the food processing machinery associated with the module. The frame or enclosure carries, supports or houses the food processing machinery and allows adjacent modules to be fastened together and individual modules to be moved within the container body of the food processing cell. The frame or enclosure also provides the hardware required for attachment of utilities, other modules and the deck flooring.

Each module is sized for easy mobility within the container body 20 of the food processing cell 10 by manual or power assisted means, such as lockable casters, a fork lift or other means. The modules have generally square or rectangular footprints, and are sized so that adjacent modules snap together easily. For example, where three adjacent functional modules perform the functions of filling, capping and labeling bottles being filled with juice, each module will be configured so that they can be connected together easily and locked down securely to the cell floor.

Figure 3:
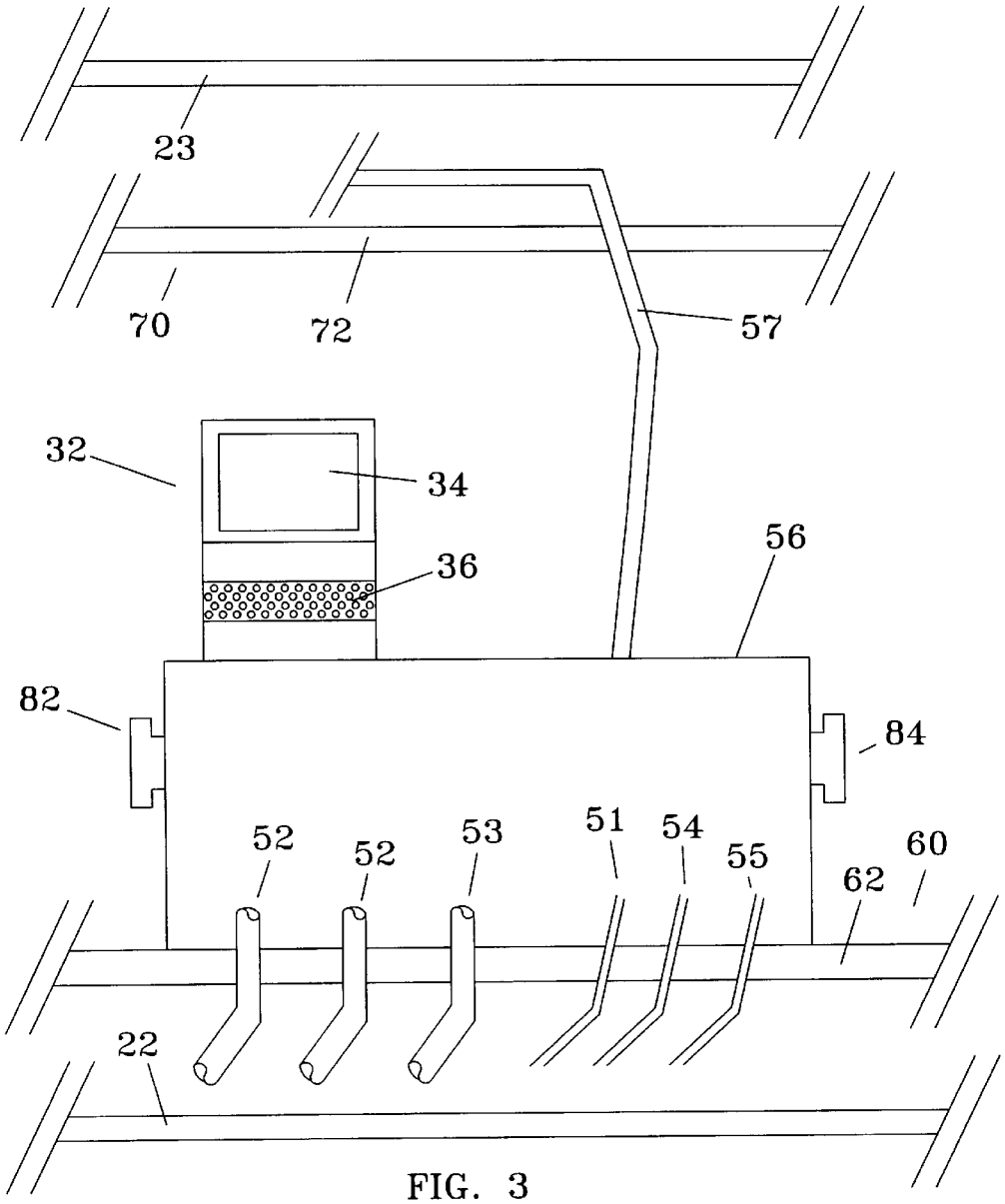
FIG. 3 is a somewhat diagrammatic orthographic view of a version of one of the functional modules contained within the shipping container body of the processing cell, showing the re-configurable decking floor and ceiling.

As seen in FIG. 3, a module 50 is carried by a deck section 62, and is elevated above the floor 22 of the container. The module receives utility services, including electricity 51, water 52, waste 53, gas 54, compressed air 55 and hydraulic power 57.

Refer to FIG. 3 and 4, transition fixtures and fittings 80 are provided to form a connection between adjacent functional modules 50 and between adjacent food processing cells 10, thereby allowing the output of one functional module or food processing cell to be the input of an adjacent functional module or food processing cell. Such transition fixtures and fittings may include power driven devices as conveyors or augers, or passive devices such as pipes and tubing. As seen in FIG. 3, if the functional module contains grinding machinery, a material input port 82 may receive material such as shelled peanuts as input, and peanut butter may be discharged from the material output port 84. In a typical application, the output port 84 of the first functional module would then be connected to the input port 82 of an adjacent functional module 50 for packaging in glass jars or similar packaging.

A computer control system 30 controls the operation of the functional modules 50 contained by each cell 10. The computer control system provides an interface 32 with workers 16 which may include visual instructions to the operators of the module, cell or line including several modular food processing cells. The instructions may be transmitted on a video displays 34 (e.g. CRT monitor, flat panel displays, etc.), or may be made in any other desired manner. For example, the instructions to the operators could be by recorded voice, alarm sound or any other known signal device. Where the operator communicates with the computer control system, the operator's input may be made by keyboard 36, touch-screen, mouse or other graphical pointer or other known input device.

The computer control system provides the data bases and algorithms needed to direct the control of the modules. The computer control system controls and monitors the process parameters of each module, cell and a line (two or more cells), thereby ensuring that the output of each module is released at the appropriate time to the next module in the modular food processing cell. The entire computer control system may be housed within the cell, in a separate control cell or in a remote location. Where the computer control is remote, connection may be made via an intranet, the internet, modem or wide area network.

Figure 5:
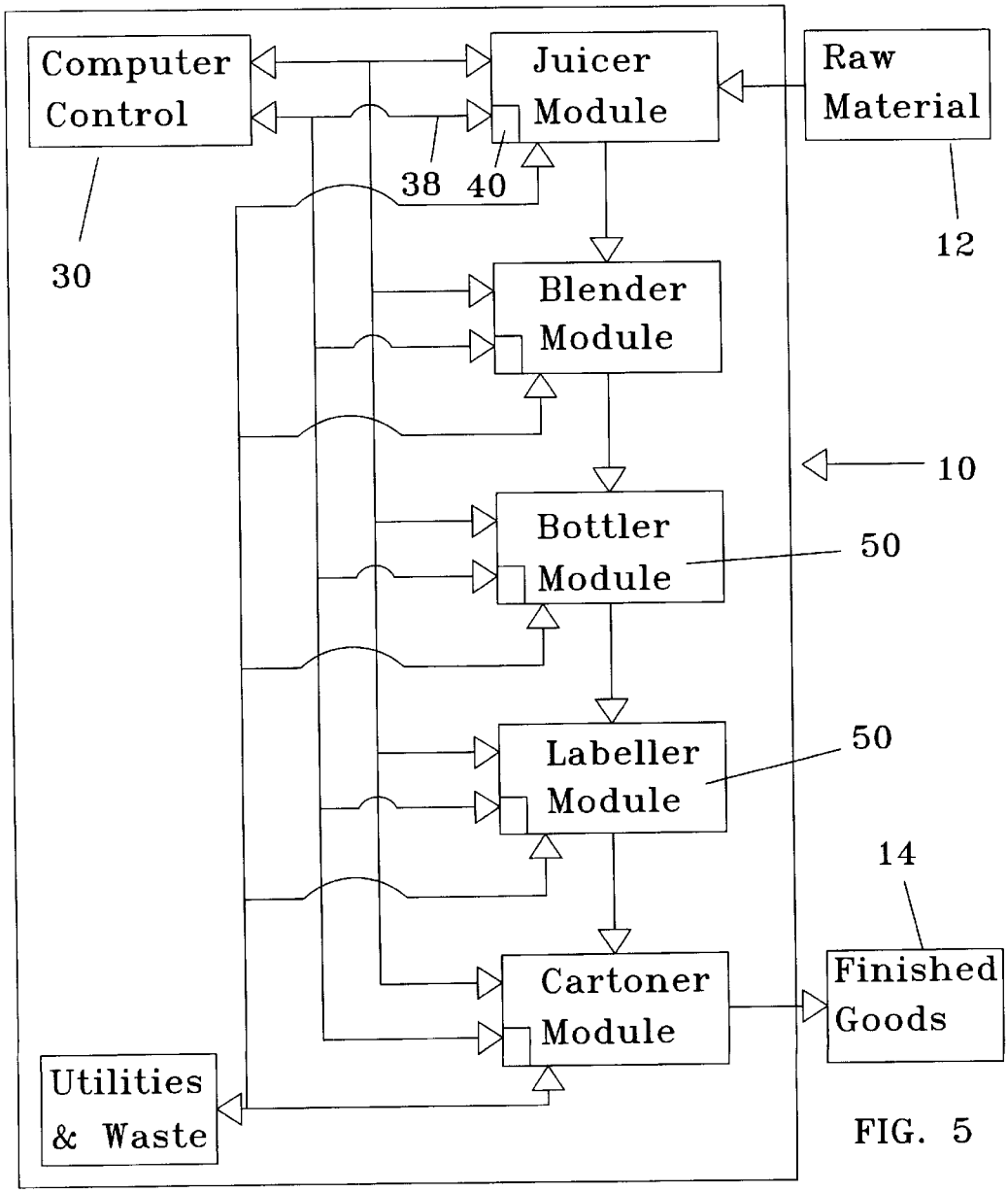
FIG. 5 is a flow chart diagram illustrating an example of how a number of functional modules may interact within one re-configurable modular food processing cell.

As seen in FIG. 5, control circuitry 40 within each module is interfaced with the computer control system 30 carried by the modular food processing cell 10. This interface allows the computer control system to monitor and control the operation of each functional module 50. In particular, the interface or connection 38 between the computer control system 30 and the functional modules 50 would control the operation of each module by means of the module's control circuitry 40.

Each module's control circuitry 40 may be electrical, electo-mechanical or software driven, and controls a variety of functions, such as turning the module on or off, controlling the speed of the module's operation, controlling specifics related to recipes, temperature, cook time, degree of blending, etc., depending in part on the functionality of the module. Providing the computer control system 30 with an interface 38 to the control circuitry 40 of each functional module 50 allows better coordination between the modules. For example, where the output of a first module is the input of a second module, information from the control circuitry 40 would allow the computer control system 30 to determine the parameters for material transfer. Directions from the computer control system could then direct the control circuitry 40 in the functional modules to operate accordingly.

The invention resides not in any one of these features per se, but rather in the particular combination of all of them herein disclosed and claimed and it is distinguished from the prior art in this particular combination of all of its structures for the functions specified.

The previously described versions of the present invention have many advantages, including a primary advantage of providing agile manufacturing lines consisting of rapidly re-configurable modular food processing cells wherein each cell is comprised of a plurality of functional modules for automating individual steps in the food processing process, and wherein the modules may be rearranged, swapped or re-configured, as indicated by specific needs.

Another advantage of the present invention is to provide agile manufacturing lines consisting of rapidly re-configurable modular food processing cells where a number of cells can be combined, as needed, to accomplish larger tasks.

Another advantage of the present invention is to provide agile manufacturing lines consisting of rapidly re-configurable modular food processing cells that may be easily transported from place to place, and that are adaptable for use in or near agricultural fields.

Another advantage of the present invention is to provide agile manufacturing lines consisting of rapidly re-configurable modular food processing cells that may be transported in Sea/Land- or CONEX-type shipping boxes, wherein each shipping box additionally forms the superstructure or housing of a modular food processing cell, i.e. the minimum manufacturing facility.

Another advantage of the present invention is to provide agile manufacturing lines consisting of rapidly re-configurable modular food processing cells that are adapted for the production of food in relatively small quantities, e.g. gourmet or specialty foods, and that may be housed in a facility.

Another advantage of the present invention is to provide agile manufacturing lines consisting of rapidly re-configurable modular food processing cells that are adapted for the preservation of food in developing countries worldwide and also for crisis crop preservation by areas hit by natural or manmade disaster.

Although the present invention has been described in considerable detail and with reference to certain preferred versions, other versions are possible. For example, while a specifics of a number of functional modules have been stated, it is understood that the invention resides in part in the concept of interlocking modules within a cell that are re-configurable by means of a re-configurable decking comprising a plurality of deck sections to support a variety of specific applications, wherein transitional fittings pipe the output of a first module into the input of a second module. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A re-configurable modular food processing cell, comprising:

(A) at least one food processing cell, comprising:

(a) a container enclosure, adapted for transport;

(b) re-configurable deck flooring means, carried within the container enclosure, for rapid rearrangement and customization of an interior of the container body, the re-configurable deck flooring means comprising at least two deck sections;

(c) at least two functional modules, each carried by one of the at least two deck sections, whereby the modules may be rearranged, swapped or reconfigured, as indicated by specific needs, the at least two functional modules each adapted to carry food processing machinery having control circuitry means for controlling the operation of the food processing machinery; and (d) computer control system means, in communication with the control circuitry means each of the at least two functional modules for controlling the operation of the food processing machinery contained by each functional module; and (B) standardized transition fixture and fitting means, carried by each of the at least two functional modules, for connecting the at least two functional modules, whereby a material output of a first functional module is connected to a material input of a second functional module, thereby allowing material transfer between the at least two functional modules.

2. The re-configurable modular food processing cell of claim 1, additionally comprising:

(A) standardized transition fixture and fitting means, carried by the re-configurable modular food processing cell, for connection to a second similar re-configurable modular food processing cell, whereby the material output from the first re-configurable modular food processing cell could be input to the second re-configurable modular food processing cell.

* * * * *